United States Patent [19]

Wisotsky

[11] 4,255,589

[45] Mar. 10, 1981

[54] PROCESS FOR THE PRODUCTION OF OIL-SOLUBLE POLYOL ESTERS OF DICARBOXYLIC ACID MATERIALS IN THE PRESENCE OF A METAL SALT OF A HYDROXY AROMATIC COMPOUND

[75] Inventor: Max J. Wisotsky, Highland Park, N.J.

[73] Assignee: Exxon Research & Engineering Co., Florham Park, N.J.

[21] Appl. No.: 53,258

[22] Filed: Jun. 29, 1979

[51] Int. Cl.[3] ..... C07C 69/593

[52] U.S. Cl. ..... 560/198; 252/42.7

[58] Field of Search ..... 560/198

[56] References Cited

U.S. PATENT DOCUMENTS

| | | | |
|---|---|---|---|
| 3,057,908 | 10/1962 | Gruschke et al. | 560/198 |
| 3,331,776 | 7/1967 | Krukziener | 560/198 |
| 3,381,022 | 4/1968 | Le Suer | 560/198 |
| 3,697,428 | 10/1972 | Meinhardt et al. | 560/198 |
| 4,119,553 | 10/1978 | Cane et al. | 560/198 |

FOREIGN PATENT DOCUMENTS

| | | | |
|---|---|---|---|
| 2002393 | 2/1979 | United Kingdom | 560/198 |

*Primary Examiner*—Joseph E. Evans

*Attorney, Agent, or Firm*—R. A. Dexter; J. J. Mahon

[57] ABSTRACT

Oil-soluble polyol ester reaction products of $C_6$–$C_{10,000}$ hydrocarbon substituted $C_4$–$C_{10}$ dicarboxylic acid materials, e.g. alkenyl succinic anhydride, have been readily produced under solution reaction conditions characterized by conducting said reaction in the presence of at least a filtration suppressing insolubles reducing amount of a hydrocarbon soluble metal salt of a hydroxy aromatic compound, e.g. an alkaline earth metal alkyl phenate or naphtholate, preferably an overbased calcium sulferized phenate whereby the filtration suppressing insolubles resulting from said reaction is markedly reduced to less than 1 vol. %, the product solution haze is less than 30 nephelos and as a consequence thereof the filtration of the reaction product solution is facilitated.

12 Claims, No Drawings

PROCESS FOR THE PRODUCTION OF OIL-SOLUBLE POLYOL ESTERS OF DICARBOXYLIC ACID MATERIALS IN THE PRESENCE OF A METAL SALT OF A HYDROXY AROMATIC COMPOUND

BACKGROUND OF THE INVENTION

1. Field of the Invention

This invention relates to a process for producing oil-soluble polyol ester derivatives of a dicarboxylic acid material under conditions of reduced filtration suppressing insolubles formation as well as to the resulting substantially insolubles-free product solution useful for preparing ashless dispersants utilized in lubricating oil and fuel compositions. In particular, this invention is directed to an insolubles-free solution process involving the polyol esterification of alkenyl succinic anhydride preferably poly(isobutenyl) succinic anhydride to provide lubricating oil and fuel additives wherein said reaction is carried out in the presence of an insolubles-reducing amount of an oil-soluble metal salt of a hydroxy aromatic compound.

2. Description of the Prior Art

During the past several decades, ashless sludge dispersants have become increasingly important, primarily in improving the performance of lubricants in keeping the engine clean of deposits and permitting extended crankcase oil drain periods while avoiding the undesirable environmental impact of the earlier used metal-containing additives. Most commercial ashless dispersants fall into several general categories.

One category of ashless dispersants involves the esterification product of alkenyl substituted acids, e.g. polyisobutenyl succinic acids, with polyols, e.g. pentaerythritol, as taught in U.S. Pat. No. 3,381,022; however, the usual process of making such a dispersant requires not only an esterification catalyst (such as sulfuric acid, benzene sulfonic acid, p-toluene sulfonic acid, phosphoric acid, etc., see col. 5, lines 68–75) but must be carried out at such an elevated temperature that large amounts, i.e. in the range of 2 to 6 vol.%, of insolubles are formed.

One approach to removal of the resulting insolubles, stated to be unconverted, insoluble pentaerythritol, is to conduct the esterification in the presence of a pyridine base which functions both to reduce the buildup of sublimates by its dissolution and as an entrainer to remove the unwanted by-products of the esterification (see U.S. Pat. No. 4,199,553). Unfortunately, this approach requires subsequent removal of the pyridine base with its environmental and extra process cost parameters, a long esterification time and introduces an insoluble phase which suppresses filtration of the product including an increase of filtration time.

SUMMARY OF THE INVENTION

One approach to overcoming these limitations of the prior art processes is to carry out the esterification process in the presence of a sediment-reducing amount, e.g. 0.1 to 15 wt.% of an oil-soluble $C_{12}$–$C_{80}$ sulfonic acid as disclosed in pending application Ser. No. 385 filed Dec. 29, 1978, now abandoned, which is of common assignee with this application.

It has now been discovered that the problem of filtration-suppressing insolubles formation in the solution esterification of an alkenyl succinic anhydride, e.g., poly(isobutenyl) succinic anhydride, with a polyol can be overcome by incorporating into said esterification solution a filtration suppressing insolubles-reducing amount, e.g., 0.1 to 5, preferably 0.2 to 1.5, wt.% of an oil-soluble metal salt of a hydroxy aromatic compound, preferably an overbased magnesium sulfurized phenate. This invention can thus be characterized as a process for the preparation of a polyol ester of a hydrocarbon-soluble $C_{50}$–$C_{200}$ hydrocarbon substituted $C_4$–$C_{10}$ dicarboxylic acid material, preferably $C_{60}$–$C_{150}$ olefin substituted succinic anhydride, comprising the step of solution reacting said dicarboxylic acid material, for example, polyisobutylene succinic anhydride, with a polyol (in a mole ratio range of 0.5–2 to 1, preferably 0.9 to 1.0, of dicarboxylic acid material to polyol) in the presence of an insolubles-reducing amount, generally from 0.1 to 5, preferably 0.2 to 1.5, wt.% of an oil-soluble metal salt of a hydroxy aromatic compound, usually an alkaline earth metal alkyl phenate or naphtholate, preferably a magnesium or calcium sulfurized alkyl phenate or mixture of both, optimally overbased magnesium sulfurized $C_8$ to $C_{20}$ alkyl phenate having a total base number (TBN) of 80 to 300, said wt.% based upon the total weight of the charge. The esterification reaction temperature ranges from 120°–260° C., preferably 170°–225° C. and is for a period of from 2–10 hours, preferably 3–5 hours.

DETAILED DESCRIPTION OF THE INVENTION

Dicarboxylic Acid Material

The preparation of a polyol ester of the dicarboxylic acid material preferably involves a reaction of an alkenyl succinic acid analog obtained via the Ene reaction of an olefin with an alpha-beta unsaturated $C_4$ to $C_{10}$ dicarboxylic acid, or anhydrides or esters thereof, such as fumaric acid, itaconic acid, maleic acid, maleic anhydride, dimethyl fumarate, etc. The dicarboxylic acid material can be illustrated by an alkenyl substitute anhydride which may contain a single alkenyl radical or a mixture of alkenyl radicals variously bonded to the cyclic succinic anhydride group, and is understood to comprise such structures as:

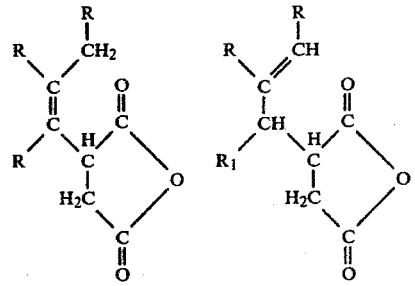

wherein R may be hydrogen or hydrocarbon or substituted hydrocarbon containing from 1 to 10,000 carbons with the restriction that at least one R has at least 6 carbons, preferably from 10 to 150 carbons and optimally from 60 to 100 carbons. The anhydrides can be obtained by well-known methods, such as the reaction between an olefin and maleic anhydride or halosuccinic anhydride or succinic ester. In branched olefins, particularly branched polyolefins, R may be hydrogen, methyl or a long-chain hydrocarbon group. However, the exact structure may not always be ascertained and the various R groups cannot always be precisely defined in the Ene products from polyolefins and maleic anhydride.

Suitable olefins include butene, isobutene, pentene, decene, dodecene, tetradecene, hexadecene, octadecene, eicosene, and polymers of propylene, butene, isobutene, pentene, decene and the like, and halogen-containing olefins. The olefins may also contain cycloalkyl and aromatic groups. The most preferred alkenyl succinic anhydrides used in this invention are those in which the alkenyl group contains a total of from 6 to 10,000 carbon atoms; and, at least 5 to 150 and more preferably 60 to 150 for mineral oil systems.

Many of these hydrocarbon substituted dicarboxylic acid materials and their preparation are well known in the art as well as being commercially available, e.g., 2-octadecenyl succinic anhydride and polyisobutenyl succinic anhydride.

With 2-chloromaleic anhydride and related acylating agents, alkenylmaleic anhydride reactants are formed.

Preferred olefin polymers for reaction with the unsaturated dicarboxylic acids are polymers comprising a major molar amount of $C_2$ to $C_5$ monoolefin, e.g., ethylene, propylene, butylene, isobutylene and pentene. The polymers can be homopolymers such as polyisobutylene, as well as copolymers of two or more of such olefins such as copolymers of ethylene and propylene; butylene and isobutylene; propylene and isobutylene; etc. Other copolymers include those in which a minor molar amount of the copolymer monomers, e.g. 1 to 20 mole % is a $C_4$ to $C_{18}$ nonconjugated diolefin, e.g., a copolymer of isobutylene and butadiene; or a copolymer of ethylene, propylene and 1,4-hexadiene; etc.

The olefin polymers will usually have number average molecular weights ($\overline{M}_n$) within the range of 700 and about 140,000; more usually between about 900 and about 10,000. Particularly useful olefin polymers have ($\overline{M}_n$) within the range of about 1200 and about 5000 with approximately one terminal double bond per polymer chain. An especially valuable starting material for a highly potent dispersant additive are polyalkenes e.g. polyisobutylene, having about 90 carbons.

Especially useful when it is desired that the dispersant additives also possess viscosity index improving properties are 5,000 to 200,000 e.g., 25,000 to 100,000 number average molecular weight polymers. An especially preferred example of such a V.I. improving polymer is a copolymer of about 30 to 85 mole % ethylene, about 15 to 70 mole % $C_3$ to $C_5$ mono-alpha-olefin, preferably propylene, and 0 to 20 mole % of a $C_4$ to $C_{14}$ non-conjugated diene.

These ethylene-propylene V.I. improving copolymers or terpolymers are usually prepared by Ziegler-Natta synthesis methods. Some of these copolymers and terpolymers are commercially available such as VISTALON®, an elastomeric terpolymer of ethylene, propylene, and 5-ethylidene norbornene, marketed by Exxon Chemical Co., New York, NY and NORDEL®, a terpolymer of ethylene, propylene and 1,4-hexadiene marketed by E. I. duPont de Nemours & Co.

The Polyol

The polyhydric alcohol used to react with the dicarboxylic acid material can have a total of 2 to 40 carbon atoms and can be represented by the formula:

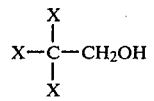

wherein X is hydrogen, an alkyl, hydroxy alkyl, $—OCH_2C—(CH_2OH)_3$, $—(CH_2)_nOH$, or $—(CH_2OCH_2CH_2O)_nH$ wherein n is 1 to 3 with at least one of the X substituents being a hydroxy alkyl group and preferably all of the X substituents being a hydroxy alkyl group of the structure $—(CH_2)_nOH$, wherein n is 1 to 3.

Examples of such polyols are illustrated by ethylene glycol, diethylene glycol, triethylene glycol, tetraethylene glycol, dipropylene glycol, tripropylene glycol, dibutylene glycol, tributylene glycol, and other alkylene glycols in which the alkylene group contains from two to about eight carbon atoms. Other useful polyhydric alcohols include glycerol, monooleate of glycerol, monostearate of glycerol, monomethyl ether of glycerol, pentaerythritol, 9,10-dihydroxy stearic acid, methyl ester of 9,10-dihydroxy stearic acid, 1,2-butanediol, 2,3-hexanediol, 2,4-hexanediol, pinacol, erythritol, arabitol, sorbitol, mannitol, 1,2-cyclohexanediol, and xylene glycol. Carbohydrates such as sugars, starches, celluloses, etc., likewise may yield the esters of this invention. The carbohydrates may be exemplified by glucose, fructose, sucrose, rhamnose, mannose, glyceraldehyde, and galactose.

An especially preferred class of polyhydric alcohols are those having at least three hydroxyl groups, such as pentaerythritol, dipentaerythritol, tripentaerythritol, sorbitol and mannitol. Solubility of some polyhydric alcohols may be increased by esterifying some of the hydroxyl groups with a monocarboxylic acid having from about 8 to about 30 carbons atoms such as octanoic acid, oleic acid, stearic acid, linoleic acid, dodecanoic acid, or tall oil acid. Examples of such partially esterified polyhydric alcohols are the monooleate of sorbitol, distearate of sorbitol, monooleate of glycerol, monostearate of glycerol, and dodecanoate of erythritol. Because of its effectiveness, availability, and cost, pentaerythritol is particularly preferred.

Oil-Soluble Metal Salts of Hydroxy Aromatic Compounds

According to this invention, the material for inhibiting the formation of filtration suppressing insolubles in the esterification of the dicarboxylic acid material with the polyol is a metal salt of an aromatic hydroxy compound.

The aromatic hydroxy compounds are primarily phenol and naphthol with their sulfide and aldehyde condensation derivatives. The metals used to form normal and basic salts are preferably the alkaline earth metals and optimally magnesium and calcium since each readily provides a basic salt which contains more metal than is required for the indicated neutralization reaction. Practically, all commercially available detergent additives such as calcium phenate, magnesium phenate, calcium sulfurized phenate, magnesium sulfurized phenate, etc., are basic salts. It is the intent of this invention to teach that usefully alkaline earth metal basic phenates and naphtholates are desirable for reduction of the amount of filtration suppressing insolubles normally produced by prior art polyol esterification processes.

When mineral oil is utilized in the solution esterification with a polyol such as pentaerythritol, it is desired to use an oil-soluble derivative which is obtained by reaction with an alkyl substituted phenol or naphthol having alkyl substituents averaging at least 9 carbons, although the individual alkyl groups may contain 5 to 40 carbon atoms in order to ensure adequate oil-solubility of the resulting salt, preferably magnesium and/or calcium salt.

It is preferred to use sulfurized magnesium phenate, sulfurized calcium phenate or a sulfurized mixed magnesium-calcium phenate, optimally an overbased basic salt having a TBN of from 80 to 300.

Sulfurized Magnesium Phenate

The sulfurized magnesium phenates can be considered the "magnesium salt of a phenol sulfide" which thus refers to a magnesium salt, whether neutral or basic, of a compound typified by the general formula:

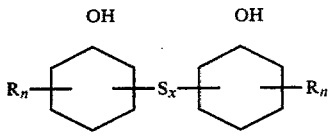

or a polymeric form of such a compound, where R is an alkyl radical, n and x are each integers from 1 to 4, and the average number of carbon atoms in all of the R groups is at least about 9 in order to ensure adequate solubility in oil of the salt. The individual R groups may each contain from 5 to 40, preferably 8 to 20, carbon atoms. The magnesium salt is prepared by reacting an alkyl phenol sulfide with a sufficient quantity of magnesium containing material to impart the desired alkalinity to the sulfurized magnesium phenate.

The phenol sulfides may be prepared by well-known means, for example, by reacting an alkylated phenol with sulfur monochloride or sulfur dichloride. With either of these reagents, a mixture of the phenol monosulfide and phenol disulfide is generally produced, although polysulfides and polymeric materials will also be formed. The polymeric sulfides usually result when more than the theoretically required proportion of sulfur halide is used in preparing the alkyl phenol sulfide. Such polymeric materials having a total of 30–40 carbon atoms in the molecule form highly oil-soluble magnesium salts and are preferred in this invention. It is to be understood that the term alkyl phenol sulfide is meant to include not only the mono- and disulfides but the polysulfides and polymers of alkyl phenol sulfides as well.

The alkylated phenol from which the phenol sulfide is prepared is obtained by known alkylation processes; the phenol being generally reacted with such alkylating agents as isobutylene, isoamylene, diisobutylene, triisobutylene, etc., or olefin-containing mixtures obtained from refinery gases. Boron trifluoride is a preferred alkylating agent.

Among the $C_5$–$C_{40}$ alkylated phenols which are preferably employed in preparation of sulfurized magnesium phenates may be mentioned as t-amyl phenol, isohexyl phenol, t-octyl phenol, nonyl-phenol, di-tert-octyl phenol, waxy-alkylated phenols, phenols alkylated with suitable branched chain polymers of up to 40 carbons obtained from propylene, butylene, amylenes or mixtures thereof, and the like. Optimally, nonyl or dodecyl (or either of their equivalents in a mixture of alkyls) phenol is employed.

Regardless of the manner in which they are prepared, the sulfurized alkylphenols which are useful contain from about 2 to about 14% by weight, preferably about 4 to about 12, sulfur based on the weight of sulfurized alkylphenol.

A wide variety of nonvolatile diluent oils, such as mineral lubricating oils are suitable for the preparation of the sulfurized alkylphenols. The nonvolatile diluent oils preferably have a boiling point in excess of about 200° C.

The sulfurized alkyl phenol is converted by reaction with a magnesium-containing material including oxides, hydroxides and complexes in an amount sufficient to neutralize said phenol and, if desired, to overbase the product to a desired alkalinity. Preferred is a process of neutralization utilizing a solution of magnesium in a glycol ether.

Suitable glycol ethers include monoethers of ethylene glycol and monoethers of diethylene glycol containing up to 8 carbon atoms. Preferred glycol ethers are the monomethyl ether of ethylene glycol and the monomethyl ether of ethylene glycol.

As indicated in the foregoing, the magnesium used in the process is present as a solution in the suitable glycol ether. In some cases it may be desirable to use a carbonated magnesium alkoxide. The glycol ether solution of the metal contains from about 1 to about 30 weight percent, preferably from about 5 to about 25 weight percent of the metal.

A highly basic magnesium sulfurized alkyl phenate can be readily prepared according to a process wherein a mixture of sulfurized alkyl phenol, e.g. sulfurized nonyl phenol, nonvolatile diluent oil, volatile process solvent having a boiling point below about 150° C., e.g. a glycol ether and water, are admixed with an overbasing amount of magnesium in a glycol ether solvent, e.g. the monomethyl ether of diethylene glycol at a temperature of 20° to about 55° C.; then adding to said admixture a neutralizing amount of magnesium in said glycol ether at a temperature of 55° C. to 100° C. and removing the volatile materials by heating. A finely divided dispersoid material can be obtained by blowing said admixture with carbon dioxide during the final heating step whereby substantially complete carbonation of the alkaline earth metal compound is accomplished simultaneous with removal of volatile materials. For use in this invention, it is preferred that the sulfurized magnesium phenate should have a total base number (TBN) ranging from about 80 to about 300. TBN as used in this specification refers to the milligrams of potassium hydroxide required to neutralize the metal, e.g. magnesium or calcium, content of a 1 gram sample according to ASTM Method D-2896, approved March 1974 by the American Standards Association.

Sulfurized Calcium Phenate

As used herein, sulfurized calcium phenates can be considered the "calcium salts of a phenol sulfide" wherein the phenol sulfide is that class of compounds as defined in the earlier discussion of sulfurized magnesium phenates. The neutral or normal sulfurized calcium phenates are those in which the ratio of calcium to phenol nucleus is about 1:2. The "overbased" or "basic" sulfurized calcium phenates are sulfurized calcium phenates wherein the ratio of calcium to phenol is greater than that of stoichiometry, e.g. basic sulfurized calcium dodecyl phenate has a calcium content up to and greater than 100% in excess of the calcium present in the corresponding normal sulfurized calcium phenates wherein the excess calcium is produced in oil-soluble or dispersible form (as by reaction with $CO_2$).

Oil-soluble neutral and overbased sulfurized calcium phenates can be prepared by the reaction of alkylated phenols or naphthols with calcium oxides or hydroxides in the presence of glycols and sulfur. As used herein, the term "phenol" means phenol and derivatives of phenol; "naphthol" means naphthol and derivatives of naphthol; similarly, the term "calcium phenate" means the calcium salt of phenol and derivatives of phenol and "calcium naphtholates" means the calcium salt of naphthol and naphthol derivatives (similar terminology applies to magnesium salts).

The calcium phenates and naphtholates which can be reacted with sulfur to form the sulfurized calcium salts are of the formula:

$$[(R)_aAO]_2Ca$$

wherein A is an aromatic radical, preferably a benzene radical, R is a cyclic, straight-chain or branched-chain, saturated or unsaturated, essentially hydrocarbon radical having from 5 to 30, preferably 8–20, optimally about 12, carbon atoms, O represents oxygen and a is a number ranging from 1 to 4.

Examples of suitable hydrocarbon radicals include alkyl radicals such as amyl, hexyl, octyl, decyl, dodecyl, hexadecyl, eicosyl, triacontyl radicals; radicals derived from petroleum hydrocarbons, such as white oil, wax, olefin polymers (e.g. polypropylene and polybutylene); aralkyl radicals, such as phenyloctyl, phenyldecyl, phenyloctadecyl, etc.; alkaryl radicals such as amylphenyl, cetylphenyl, etc., and cyclic non-benzenenoid radicals, such as cyclohexyl, bornyl, etc.

The glycols used as the solvent to prepare the sulfurized calcium phenates may contain up to 8 carbon atoms. Suitable glycols include: ethylene glycol, propylene glycol, butanediol-2,3; pentanediol-2,3; and 2-methyl butanediol-3,4.

The basic sulfurized calcium phenates may be prepared from normal calcium alkyl phenates or from phenols. When phenols are used as starting materials, the phenols are treated with calcium oxide or hydroxide to form the desired normal calcium phenates, which phenates are then treated further with calcium oxide or hydroxide and sulfur to form the sulfurized basic calcium phenate. On the other hand, the phenols may be treated with calcium oxides or hydroxides and sulfur in amounts sufficient to form the sulfurized basic calcium phenates directly without the initial formation and separation of the normal calcium phenates.

The amount of bound sulfur present in the reaction mixture can vary from 10 mol percent to 200 mol percent (based on the calcium). It is preferred to use from 50 to 125 mol percent (based on calcium).

As noted hereinabove, the amount of calcium oxide or hydroxide used is that amount which will be sufficient to give the basic sulfurized calcium phenate an amount of calcium of from about 5% to about 100% more calcium than that which is present in the normal calcium phenates to provide a TBN of 80 to 300. Normally, in the preparation of this basic sulfurized calcium phenate, a slight excess (e.g. 10 mol percent excess) of calcium oxide or hydroxide is used in the reaction over that desired in the final basic phenate product.

In the reaction process it is preferred to incorporate mineral oil in the mixture because the resulting mineral oil solution is then readily usable as an additive for purposes of this invention.

Esterification Conditions

As discussed, the polyol esters may be readily prepared by adding together 0.5 to 2 to 1, preferably 0.9 to 1, of said polyol per mole of the dicarboxylic acid material with an inert diluent preferably mineral oil and heating with from 0.2 to 1.5 wt.% of a metal salt of a hydroxy aromatic compound at 120°–260° C., preferably 140°–230° C. until reaction is complete by infrared analysis of the product showing maximal absorption for ester.

The water formed as a by-product is removed by distillation as the esterification proceeds. The inert diluent or solvent may be used in the esterification to facilitate mixing and temperature control. The useful solvents which are inert in the above reaction include the preferred hydrocarbon oils, e.g. mineral lubricating oil, kerosene neutral mineral oils, xylene halogenated hydrocarbons, e.g., carbon tetrachloride, dichlorobenzene, tetrahydrofuran, etc.

Esterification according to the prior art processes generally resulted in a large volume of insolubles. These insolubles suppressed filtration of the product solution both by slowing down the filtration rate and requiring excessive capacity for filtered insolubles. These insolubles which are designated herein as filtration suppressing insolubles are perceived as sediment (large-sized insolubles) and as haze-causing dispersoids in the product solution. For improved filtration the product solution should contain less than about 1.5 volume percent of sediment and have a haze of less than about 35 nephelos.

This invention has made it possible to readily esterify the acid material with low to minimal filtration suppressing insolubles formation during esterification in a single step process that provides a readily filterable product solution.

This invention will be further understood by reference to the following Examples which include preferred embodiments of the invention.

EXAMPLE 1

A fifty-gallon glass-lined reactor provided with a stirrer was first charged with 136 pounds of polyisobutenyl succinic anhydride of number average molecular weight ($\overline{M}_n$) of about 1300 (carbon chain lengths of substituent hydrocarbon group of 35 to 700 carbons) dissolved in an equal weight of mineral oil. The charge was heated to 218° C. and 18.4 pounds of pentaerythritol added with stirring over a 1-hour period. The total charge was then soaked at 218° C. for 3 hours and then allowed to cool over 3 hours to 170° C. The product solution had 2.2 volume percent sediment and a haze of 60 nephelos prior to filtering.

EXAMPLE 2

The charge herein was 120 lbs. of polyisobutenyl succinic anhydride of ($\overline{M}_n$) of 1300 dissolved in 102 lbs. of mineral oil. The charge was heated to 190° C. at which time 14.2 lbs. of pentaerythritol and 1 lb. of an overbased magnesium phenate with a TBN of 240 dissolved in 0.6 lbs. of mineral oil were added over a 1.5 hr. period. The charge was then heated to 218° C. over a one-hour period, maintained at 218° C. for 3 hours and then stripped with nitrogen for one hour after which the charge was cooled over 3 hours to 170° C. The resulting product solution had 0.08 volume percent sediment and a haze of 13 nephelos prior to filtration.

EXAMPLE 3

The process of Example 2 was followed except 0.4 pound of calcium hydroxide was used to replace the overbased magnesium sulfurized phenate. The resulting product solution had a 0.9 volume percent sediment and a haze of 14 nephelos prior to filtration.

EXAMPLE 4

The process of Example 2 was followed except for soaking the charge at 190° C. rather than 218° C. and that no overbased magnesium phenate was added. The resulting product solution had 1.3 volume percent sediment and a haze of 77 nephelos prior to filtration.

EXAMPLE 5

The process of Example 2 was followed except that the charge was soaked at 190° C. rather than 218° C. The resulting product solution had 1.2 volume percent sediment and haze of 31 neph. prior to filtration.

EXAMPLE 6—Sludge Inhibition Bench (SIB) Test

The product solutions of Examples 1, 2, 3, 4 and 5 were subjected to the Sludge Inhibition Bench (SIB) Test which has been found after a large number of evaluations, to be an excellent test for assessing the dispersing power of lubricating oil dispersant additives.

The medium chosen for the Sludge Inhibition Bench Test was a used crankcase mineral lubricating oil composition having an original viscosity of about 325 SUS at 37.8° C. that had been used in a taxicab that was driven generally for short trips only, thereby causing a buildup of a high concentration of sludge precursors. The oil that was used contained only a refined base mineral lubricating oil, a viscosity index improver, a pour point depressant and zinc dialkyldithiophosphate antiwear additive. The oil contained no sludge dispersants. A quantity of such used oil was acquired by draining and refilling the taxicab crankcase at 1000–2000 mile intervals.

The Sludge Inhibition Bench Test is conducted in the following manner. The aforesaid used crankcase oil, which is milky brown in color, is freed of sludge by centrifuging for ½ hour at about 39,000 gravities (gs.). The resulting clear bright red supernatant oil is then decanted from the insoluble sludge particles thereby separated out. However, the supernatant oil still contains oil-soluble sludge precursors which on heating under the conditions employed by this test will tend to form additional oil-insoluble deposits of sludge. The sludge inhibiting properties of the additives being tested are determined by adding to portions of the supernatant used oil, a small amount, such as 0.1 to 1.0 weight percent, on an active ingredient basis, of the particular additive being tested. Ten grams of each blend being tested is placed in a stainless steel centrifuge tube and is heated at 138° C. for 16 hours in the presence of air. Following the heating, the tube containing the oil being tested is cooled and then centrifuged for 30 minutes at about 39,000 gs. Any deposits of new sludge that form in this step are separated from the oil by decanting the supernatant oil and then carefully washing the sludge deposits with 15 ml. of pentane to remove all remaining oil from the sludge. Then the weight of the new solid sludge that has been formed in the test, in milligrams, is determined by drying the residue and weighing it. The results are reported as milligrams of sludge per 10 grams of oil, thus measuring differences as small as 1 part per 10,000. The less new sludge formed the more effective is the additive as a sludge dispersant. In other words, if the additive is effective, it will hold at least a portion of the new sludge that forms on heating and oxidation, stably suspended in the oil so it does not precipitate down during the centrifuging.

Using the above-described test, the dispersant activity of each filtered product solution was determined to be that set forth in Table I.

TABLE I

| Example No. | Product Solution of Example No. | Mg Sludge/10 g oil at 0.2 wt. % | Mg Sludge/10 g oil at 0.4 wt. % |
|---|---|---|---|
| 6-1 | 1 | 7.0 | 1.9 |
| 6-2 | 2 | 2.5 | 0.1 |
| 6-3 | 3 | 7.1 | 1.8 |
| 6-4 | 4 | 8.3 | 2.7 |
| 6-5 | 5 | 7.2 | 0.8 |

The data of Table I illustrates that the dispersant activity of the product solutions of the process of the invention (Exs. 2 and 5) are superior to a product solution produced according to the prior art (Exs. 1 and 4).

A comparison of the sediment and haze values of the product solutions demonstrates why the process of the invention provides a system more readily filterable than those of the prior art. The comparison is shown in Table II.

TABLE II

| Product Solution of Example | Sediment Vol. % | Haze Nephelos |
|---|---|---|
| 1 | 2.2 | 60 |
| 2 | 0.08 | 13 |
| 3 | 0.9 | 14 |
| 4 | 1.3 | 77 |
| 5 | 1.2 | 31 |

The product solution of Example 2 is outstanding in low sediment, clarity and sludge dispersancy while that of Example 5 has useful low sediment and clarity values with impressive dispersancy activity at 0.4 wt.% concentration. Although the calcium hydroxide addition reduced sediment and haze (Example 3) with lowered dispersancy activity, it adds a discrete additional phase to the reaction charge which as an insoluble must be discharged from the reaction vessel in an additional process step with its attendant disadvantages.

The invention in its broader aspect is not limited to the specific details shown and described and departures may be made from such details without departing from the principles of the invention and without sacrificing its chief advantages.

What is claimed is:

1. In a process for the esterification in a hydrocarbon solvent at 120° to 260° C. of a $C_6$–$C_{10,000}$ hydrocarbon alkenyl substituted succinic anhydride, with a $C_2$–$C_{40}$ polyol to produce an oil-soluble, ashless dispersant, the improvement which comprises conducting said esterification in the presence of an amount of oil-soluble metal salt of an aromatic hydroxy compound sufficient to reduce the formation of filtration-suppressing insolubles, the metal salt being a normal or basic alkaline earth metal or magnesium metal salt, the aromatic hydroxy compound being phenol or naphthol, alkyl-substituted phenol or naphthol and sulfide and aldehyde derivatives of said phenol, naphthol or alkyl substituted phenol or naphthol.

2. The process of claim 1 wherein there is present from about 0.2 to 1.5 wt.% of said oil-soluble metal salt.

3. A process comprising the step of esterifying a $C_{60}$–$C_{150}$ olefin substituted succinic anhydride dissolved in mineral oil with a polyol having a total of 2 to 40 carbon atoms at a temperature of from 120° to 260° C. while in the presence of from 0.1 to 5 wt.% of an oil-soluble magnesium and/or calcium sulfurized phenate, said weight percent based on the total weight of charge.

4. A process comprising the step of esterifying from 0.5 to 1.5 moles of a $C_{60}$–$C_{150}$ polyisobutenyl succinic anhydride dissolved in mineral oil with one mole of pentaerythritol at a temperature of from 170°–225° C. while in the presence of from 0.1 to 5 wt.% of an oil-soluble overbased magnesium phenate having a total base number of from 80 to 300, said weight percent based on the total weight of charge.

5. The process of claim 1 wherein the metal salt is a basic metal salt.

6. The process of claim 1 wherein the metal salt is an alkyl phenate or alkyl naphthenate.

7. The process of claim 1 wherein the alkyl is $C_8$–$C_{30}$.

8. The process of claim 1 wherein the aromatic hydroxy compound is a sulfide of an alkyl phenol or alkyl naphthol containing about 2 to 14% by weight sulfur.

9. The process of claim 1 wherein insolubles are reduced such that the esterification product solution has less than 1.5% by volume sediment and a haze of less than about 35 nephelos.

10. The process of claim 1 wherein the polyol is represented by the formula

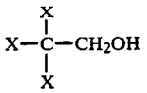

wherein X is hydrogen, an alkyl, hydroxy alkyl, $—OCH_2C(CH_2OH)_3$, $—(CH_2)_n OH$ or $—(CH_2OCH_2CH_2O)_nH$ wherein n is 1 to 3 with at least one of the X substituents being a hydroxy alkyl group.

11. The process of claim 1 wherein the metal salt is an overbased magnesium salt of a sulfurized $C_8$–$C_{20}$ alkyl phenol having a total base number of from about 80 to about 300.

12. The process of claim 1 wherein the esterification is carried out at 140° to 230° C.

* * * * *